US006526676B1

(12) United States Patent
Ledergerber

(10) Patent No.: US 6,526,676 B1
(45) Date of Patent: Mar. 4, 2003

(54) DISPOSABLE SANDAL

(76) Inventor: Gregg Ledergerber, 5924 Van Nuys Blvd., Van Nuys, CA (US) 91401

( * ) Notice: Subject to any disclaimer, the term of this patent is extended or adjusted under 35 U.S.C. 154(b) by 0 days.

(21) Appl. No.: 09/620,810

(22) Filed: Jul. 21, 2000

Related U.S. Application Data

(63) Continuation-in-part of application No. 09/281,552, filed on Mar. 30, 1999, now abandoned.

(51) Int. Cl.[7] ..... A43B 3/12
(52) U.S. Cl. ..... 36/11.5; 36/8.4
(58) Field of Search ..... 36/11.5, 8.4

(56) References Cited

U.S. PATENT DOCUMENTS

| | | | | |
|---|---|---|---|---|
| 1,144,291 | A | | 6/1915 | Boyer |
| 3,925,914 | A | | 12/1975 | Marcoux |
| 3,978,596 | A | | 9/1976 | Brown et al. |
| 4,030,212 | A | | 6/1977 | Ito |
| 4,112,599 | A | | 9/1978 | Krippelz |
| 4,387,516 | A | * | 6/1983 | Laux |
| 4,477,985 | A | | 10/1984 | Yuan-Hsiang |
| 4,571,851 | A | | 2/1986 | Yamada |
| 4,751,784 | A | | 6/1988 | Petker et al. |
| 4,864,736 | A | | 9/1989 | Bierk |
| 4,864,740 | A | * | 9/1989 | Oakley |
| 4,958,446 | A | | 9/1990 | Brown |
| 4,967,750 | A | * | 11/1990 | Cherniak |
| 5,165,183 | A | | 11/1992 | Huang |
| 5,615,496 | A | | 4/1997 | Sharpstein |
| 5,737,853 | A | | 4/1998 | Smejkal |
| 5,787,610 | A | * | 8/1998 | Brooks |

* cited by examiner

*Primary Examiner*—Ted Kavanaugh
(74) *Attorney, Agent, or Firm*—Blakely, Sokoloff, Taylor & Zafman

(57) ABSTRACT

A disposable sandal is formed from a single piece of sheet material consisting of a fabric laminated to polyurethane foam. The sole of the sandal is shaped to generally conform to the outline of a human foot. A strap portion is formed as a band of the sheet material surrounding a heel portion of the sole. The strap portion is folded over and attached to a toe portion of the sole. A series of perforations are provided at the heel and/or toe portions of the sole so that the sandals may be conveniently sized to the user's foot. In a preferred embodiment, the bottom surface of the sole is embossed with a skid-resistant pattern.

1 Claim, 1 Drawing Sheet

DISPOSABLE SANDAL

RELATED APPLICATION

This is a continuation-in-part of application Ser. No. 09/281,552 filed on Mar. 30, 1999 now abandoned.

BACKGROUND OF THE INVENTION

1. Field of the Invention

This invention relates generally to the field of disposable footwear. More particularly, the invention relates to a disposable sandal made from a single die-cut piece of sheet material.

2. Prior Art

There are many situations in which temporary use of footwear is desirable. Some examples of locations where temporary footwear may be utilized are health clubs and spas, hotels, hospitals, doctors' offices and pedicure salons. Conventional footwear can, of course, be used on a temporary basis. However, reusable footwear raises concerns about hygiene. Therefore, a disposable footwear product is preferred for temporary use.

Numerous examples of inexpensive and/or disposable footwear are known in the prior art. These include the devices shown in U.S. Pat. No. 3,925,914 to Marcoux, U.S. Pat. No. 4,477,985 to Yuan-Hsiang, U.S. Pat. No. 4,581,751 to Yamada, U.S. Pat. No. 4,751,784 to Petker, et al. and U.S. Pat. No. 5,165,183 to Huang.

SUMMARY OF THE INVENTION

The present invention provides a disposable sandal that is formed from a single piece of laminated sheet material comprising a layer of fabric and a layer of polyurethane foam. The sole of the sandal is shaped to generally conform to the outline of a human foot. A strap portion is formed as a band of the sheet material surrounding a heel portion of the sole. The strap portion is folded over and attached to a toe portion of the sole. A series of perforations are provided at the heel and/or toe portions of the sole so that the sandals may be conveniently sized to the user's foot. In a preferred embodiment, the bottom surface of the sole is embossed with a skid-resistant pattern.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
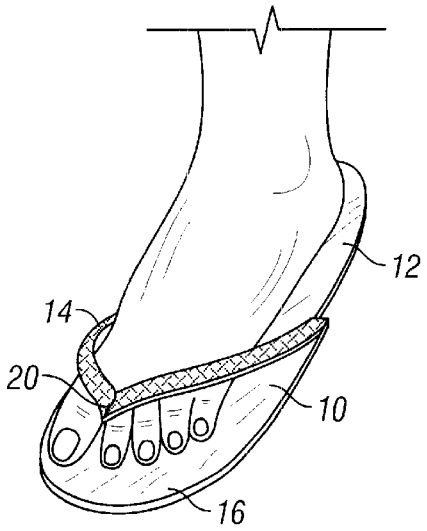
FIG. 1 is a perspective view of a disposable sandal constructed in accordance with the present invention.

FIG. 1 illustrates a sandal 10 constructed in accordance with the present invention. The sandal generally comprises a sole portion 12 and a strap portion 14. The strap portion is attached to a toe portion 16 of the sole. The user's toes straddle the point of attachment 20, thereby retaining the sandal on the user's foot.

Figure 4:
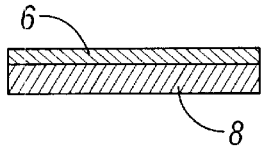
FIG. 4 is a partial cross-sectional view taken through line 4—4 of FIG. 2.

The sandal is conveniently made from sheet material using a die cutting process. The sheet material is preferably a polyurethane or similar foam, although other materials, including plastics, fabrics and paper-based materials could be used. Referring to FIG. 4, when utilizing the preferred foam material, a layer 6 of cotton or other suitable fabric is preferably glued or otherwise secured to the top surface of the foam 8. This provides greater comfort for the wearer and reduces the tendency of the wearer's foot to slip on the surface of the sandal. Use of a laminated sheet material may be advantageously used to give sandal 10 a decorative appearance with contrasting colors on the opposing surfaces.

Figure 2:
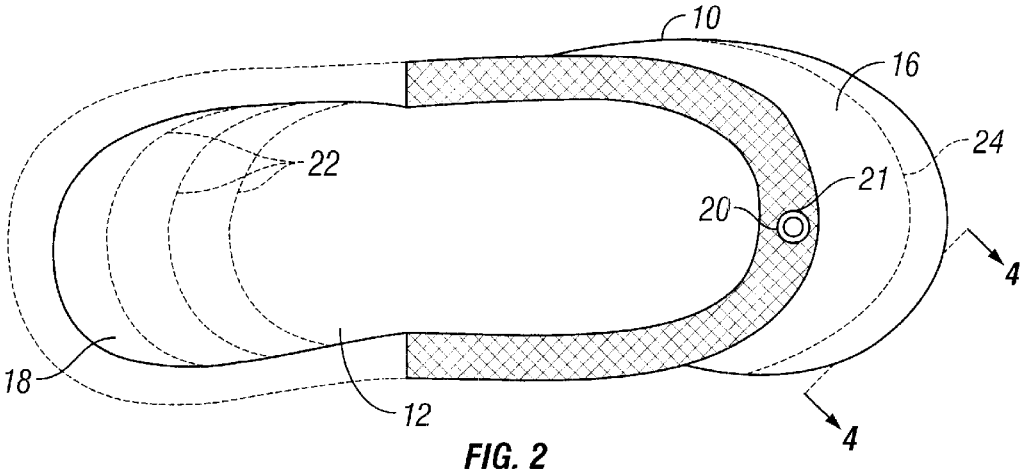
FIG. 2 is a top plan view of the sandal shown in FIG. 1.

FIG. 2 is a top plan view of sandal 10. When the sandal is cut from the sheet material, strap portion 14 is formed adjacent to the heel portion 18 as indicated by dotted lines in FIG. 2. The strap portion is then folded over the sole portion 12 and attached to the toe portion 16 at location 20. In a preferred embodiment, the strap portion is attached to the sole portion with a fastener, such as rivet 21; however, other means of attachment may be used if desired. For example, the strap portion could be attached with stitching or a suitable adhesive.

The heel portion 18 of sandal 10 is provided with a series of perforations 22. These perforations preferably extend entirely through both the sheet material 8 and fabric 6. Sandal 10 may be conveniently sized to the user's foot by tearing away sections of the heel portion at perforations 22. Generally, the size of the sandal can be adequately adjusted by removing sections of the heel portion. However, perforations 24 may also be provided at toe portion 16 if desired.

Figure 3:
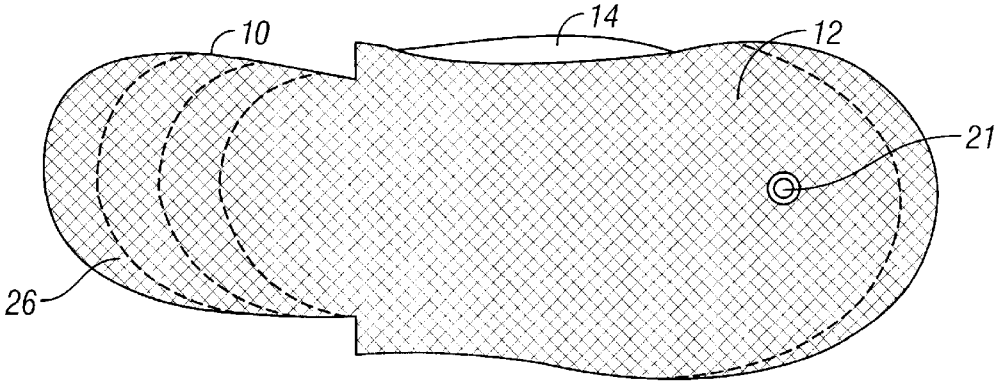
FIG. 3 is a bottom plan view of the sandal shown in FIG. 1.

FIG. 3 is a bottom plan view of sandal 10. The bottom surface 26 of the sandal, which corresponds to foam layer 8, is preferably treated to be skid resistant. This is particularly important if sandal 10 is to be worn on wet or slippery surfaces, such as around a swimming pool. Preferably, the bottom surface 26 is embossed with a pattern to provide the desired skid-resistant surface. A waffle pattern is illustrated, although any other pattern giving surface 26 a "tread" could be employed. The skid-resistant pattern may be conveniently embossed on surface 26 using a hot stamping process. Other means may also be employed to create a skid-resistant surface. For example, surface 26 could be coated with a suitably tacky material.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A disposable sandal comprising:

a single piece of sheet material having sole portion in the general outline of a human foot defining a toe portion and a heel portion and a strap portion formed as a band of the sheet material surrounding the heel portion, said strap portion contiguous with the sole portion and folded over to abut the toe portion;

a rivet attaching the strap portion to the toe portion; and each of the toe portion and the heel portion having a plurality of lines of perforations through the sheet material and spaced apart at intervals from a respective perimeter edge of each such portion to create a respective plurality of tear-away portions;

wherein the sheet material comprises a layer of polyurethane foam material of a first color and a layer of fabric material adhered thereto, said fabric material of a second color contrasting with the first color, and wherein the sheet material is embossed on a bottom side thereof with a waffle pattern, thereby providing a skid-resistant surface.

* * * * *